US006474891B1

(12) United States Patent
Liu

(10) Patent No.: US 6,474,891 B1
(45) Date of Patent: Nov. 5, 2002

(54) STRUCTURE OF A MAKE-UP PEN

(76) Inventor: Ming Hsiung Liu, P.O. Box 82-144, Taipei (TW)

( * ) Notice: Subject to any disclaimer, the term of this patent is extended or adjusted under 35 U.S.C. 154(b) by 1 days.

(21) Appl. No.: 09/995,874

(22) Filed: Nov. 29, 2001

(51) Int. Cl.[7] ..... B43K 5/06
(52) U.S. Cl. ..... 401/174; 401/172; 401/277
(58) Field of Search ..... 401/174, 173, 401/172, 171, 277, 270

(56) References Cited

U.S. PATENT DOCUMENTS

| | | | | |
|---|---|---|---|---|
| 5,454,660 A | * | 10/1995 | Sakurai et al. | 401/266 |
| 5,803,640 A | * | 9/1998 | Nakajima et al. | 401/174 |
| 5,827,002 A | * | 10/1998 | Nakajima | 401/174 |
| 5,851,079 A | * | 12/1998 | Horstman et al. | 401/174 |
| 6,227,739 B1 | * | 5/2001 | Kageyama | 401/172 |

* cited by examiner

*Primary Examiner*—David J. Walczak
*Assistant Examiner*—Huyen Le
(74) *Attorney, Agent, or Firm*—A & J

(57) ABSTRACT

An improved structure of a make-up pen is disclosed. The make-up pen comprises a pen body, a head portion, a cap body, and a material-extracting device. The pen body is provided with a cavity and the head portion is located at one end of the pen body. A brush is positioned within the head portion and a partial of the brush is extended above the head portion. The material-extracting device is mounted at a rotational cap having a driving rod, and a compression spring is mounted to the driving rod and a ratchet wheel. A securing seat is mounted to the pen body at the end portion of the driving rod. A plurality of teeth are provided to the bottom section of the securing seat and the other end of the driving rod is a screw hole having mounted with a piston rod passed through the securing seat. A piston is located at the end portion of the piston rod and the cavity contains the cosmetic lotion/cream. By rotating the rotational cap, the cosmetic lotion/cream moves upward to the head portion.

10 Claims, 5 Drawing Sheets

STRUCTURE OF A MAKE-UP PEN

BACKGROUND OF THE INVENTION (a) Technical Field of the Invention

The present invention relates to an improved structure of a make-up pen, and in particular, a make-up pen, which is portable and the amount of cosmetic or make-up lotion, can be controlled.

(b) Description of the Prior Art

Conventional make-up boxes have various sizes and contain make-up lotions or creams. But, in practical, there are drawbacks as follows: Inconvenient to carry along. Conventional pen/brush for lipstick, eyebrow pencil, or eye shadow brush are usually used together with creams or lipsticks or lotions contained in a separate container. Therefore, these items cannot be separated from one another. Therefore, all these items have to be placed in the handbag in case they are needed. But, these items are normally clustered in the handbag and it takes some time to locate the needed items. As a result, these conventional make-up items are not convenient in application. The amount of cosmetic use cannot be controlled. When a certain cosmetic is used, a brush is used to wipe the related cream and then applied to the face or the like of the user. However, the cosmetic coated to the brush cannot be easily controlled.

SUMMARY OF THE INVENTION

An object of the present invention to provide an improved structure of a make-up pen comprising a pen body having a cavity to contain a make-up lotion; a head portion being a mounting head and located at one end of the pen body and having a brush partially protruded out to the exterior thereof, and a material-guiding needle being located within the brush; a cap body mounted at one end of the pen body for the capping of the head portion; a material-extracting device including a rotational cap, a driving rod, a compression spring, a ratchet wheel, a securing seat, a piston rod and a piston, wherein the rotational cap is mounted at the other end of the pen body and has one end extended to the driving rod within the pen body, and the compression spring and the ratchet wheel are mounted onto the driving rod, and the securing seat is mounted to the pen body with the end of the driving rod, and the bottom face of the securing seat and the top face of the ratchet wheel are provided with mutually engaged teeth, and the end portion of the driving rod has a screw hole and the piston rod is mounted within the screw hole and passes through the securing seat, and the end portion of the piston rod is provided with the piston; and a plurality of make-up lotion filled at the lower section of the head portion of the pen body and the cavity located above the material-extracting device.

Another object of the present invention is to provide an improved structure of a make-up pen, wherein the make-up pen can be convenient carried in a handbag or purse, facilitating the usage of the make-up pen.

Other object and advantages of the present invention will become more apparent from the following description taken in conjunction with the accompanying drawing.

DETAILED DESCRIPTION OF THE PREFERRED EMBODIMENT

Figure 1:
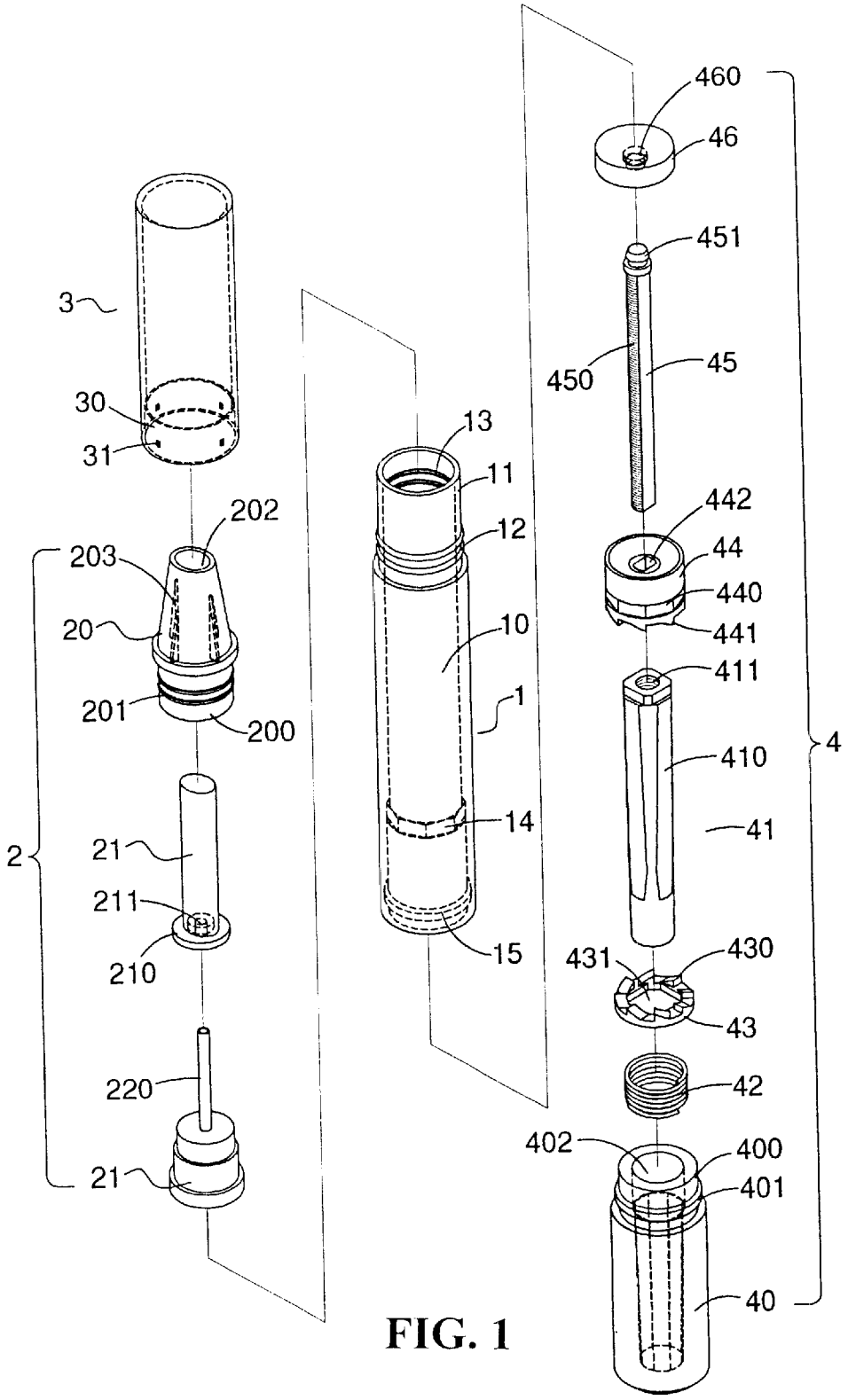
FIG. 1 is an exploded perspective view of the present invention.
Figure 2:
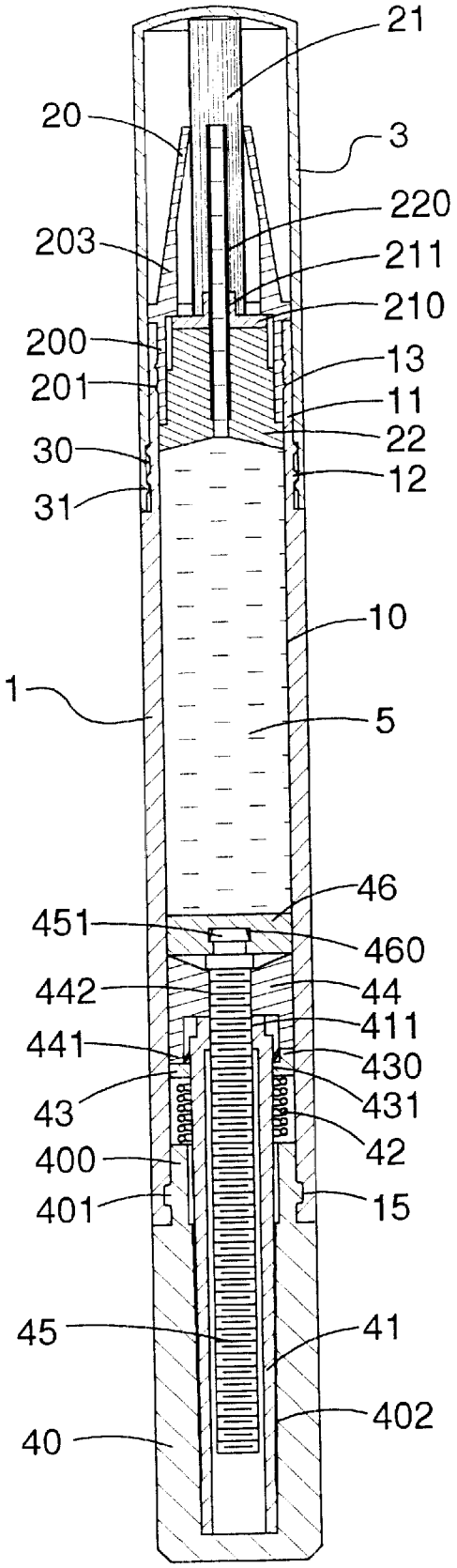
FIG. 2 is a sectional perspective view of the present invention.

Referring to FIGS. 1 and 2, there is shown an improved structure of a make-up pen comprising a pen body 1, a head portion 2, a cap body 3, and a material-extracting device.

The pen body 1 is provided with a cavity 10 to accommodate make-up lotion 5 and the top end opening to the pen body 1 is provided with a protruded edge 11 having a plurality of protruded rings 12 for the mounting of the cap body 3. The inner hole wall of the protruded edge 11 is provided with a plurality of engaging grooves for the engagement and securing of the head portion 2. The lower end of the inner hole wall of the pen body 1 is provided with a polygonal securing slot 14, and the inner hole wall, near the bottom end, is provided with a ringed slot 15 for the mounting of the material-extracting device 4.

The head portion 2 includes a mounting head 20, a brush 21 and a material-guiding needle 22.

One end of the mounting head 20 is provided with an engaging edge 200 for insertably mounting at the opening at the upper portion of the pen body 1, and the engaging edge 200 is provided with a plurality of ringed ribs 201 for engagement with the engaging grooves 13, and a through hole 202 is located on the mounting head 20 for mounting with the brush 21. The hole wall of the through hole 202 is provided with a plurality of rib plates 203, and the bottom region of the brush 21 has a protruded seat 210 for urging with the bottom region of the rib plates 203 so that the brush 21 passes through the through hole 202 and the upper section of the brush 21 is exposed above the mounting head 20, and the protruded seat 210 is provided with a through hole 211 and the material-guiding needle 22 is positioned at the bottom section of the mounting head 20 and a material directing tube 220 passed through the through hole 211 of the protruded seat 210 is provided to the material-guiding needle 22, and the end portion of the material-directing tube 220 extends to the exterior of the mounting head 20 until the front section of the brush 21 so that the make-up lotion 5 is directed to the front section of the brush 21.

The cap body 3 has a stepped slot 30 located at the opening of the inner sidewall thereof for mounting the cap body 3 onto the protruded edge 11 of the pen body 1 so that the head portion 2 can be capped thereto. The hole wall of the stepped slot 30 is provided with a plurality of protruded elements 31 for the engagement with the protruded ring 12 for securing.

The material-extracting device 4 includes a rotational cap 40, a driving rod 41, a compression spring 43, a ratchet wheel 43, a securing seat 44, a piston rod 45 and a piston 46.

One end of the rotational cap 40 is a protruded pivotal edge 400 for insertion at the opening at the bottom section of the pen body 1 and the circumferential edge of the pivotal edge 400 is a protruded ring 401 for engaging with the ringed groove 15 of the pen body 1, and the rotational cap 40 is provided with an upward opened, polygonal engaging hole 402 for the insertion of the lower section of the driving rod 41.

The circumferential edge of the driving rod 41 is provided with a plurality of engaging flat surfaces 410, allowing engagement with the engaging hole 402 of the rotational cap 40 so as to be driven to rotate, and the driving rod 41 a screw hole 411 for the mounting of the piston rod 45.

The compression spring 42 is mounted to the piston rod 41 and the bottom section of the compression spring 42 urges the top portion of the pivotal edge 400 of the rotational cap 40.

The ratchet wheel 43 is provided with a ring of teeth 430 and the ratchet wheel 43 is provided with a polygonal through holes 431 for mounting with the driving rod 41 so as to be driven by the driving rod 41 and the bottom of the ratchet wheel 43 urges against the top of the compressing spring 42.

The securing seat 44 is located at the top end of the driving rod 41 and the circumferential edge of the securing seat 44 is provided with securing engagement edge 440 of polygonal shape for mounting within the securing hole 14 of the pen body 1, and the securing seat 44 is a through hole 442 allowing the piston rod 45 to pass through.

The piston rod 45 is threaded with screw threads 450 for mounting to the screw hole 411 of the driving rod 41, and the end section of the piston rod 45 is provided with an engaging block 451 to engage with the piston 46.

The pistons 46 is located at the cavity 10 of the pen body 1 and the bottom section of the piston 46 has an engaging hole 460 for engagement with the engaging block 451 of the end portion of the piston rod 45.

The make-up lotion 5 is filled at the lower section of the material-directing needle 22 and the cavity 10 at the top portion of the piston 46.

Figure 3:
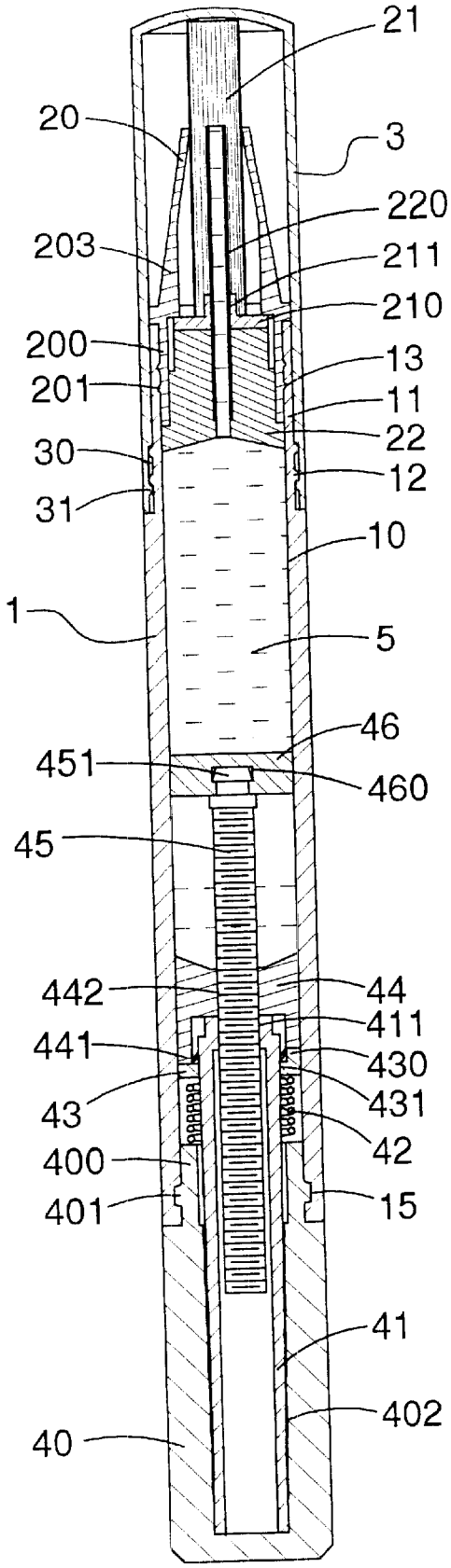
FIG. 3 schematically shows the action of an improved structure of a make-up pen of the present invention.
Figure 4:
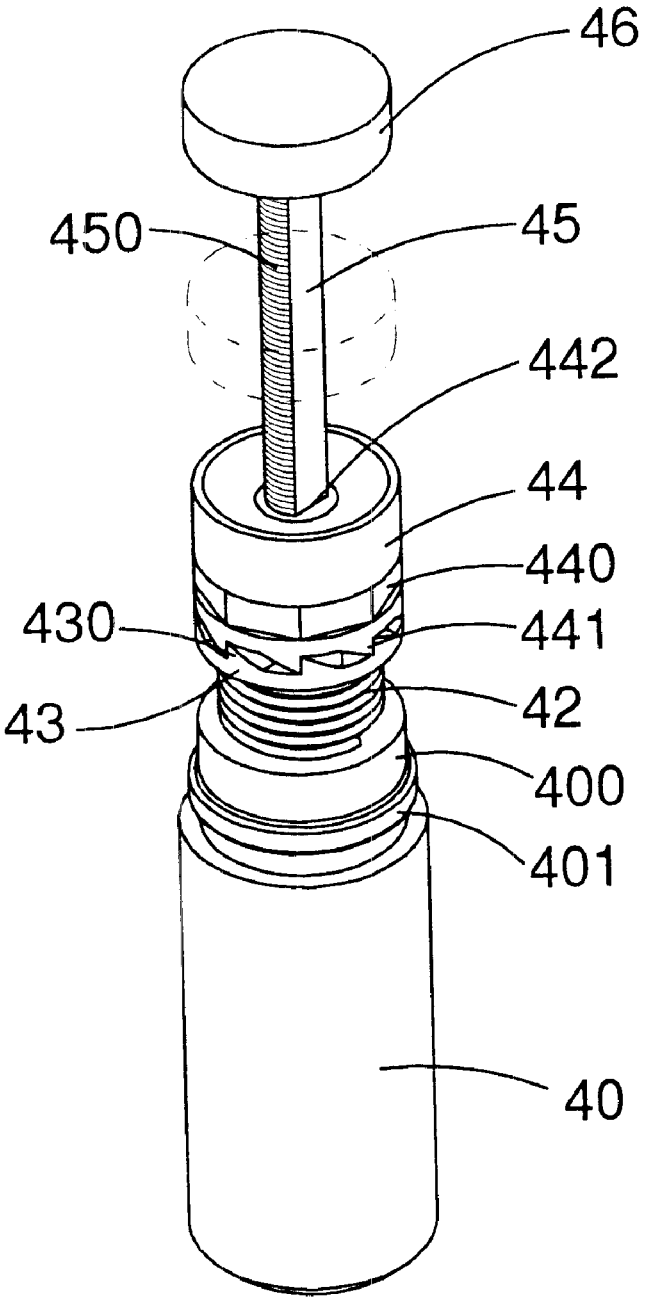
FIG. 4 is a perspective view showing the action of the material-extracting device of the present invention.
Figure 6:
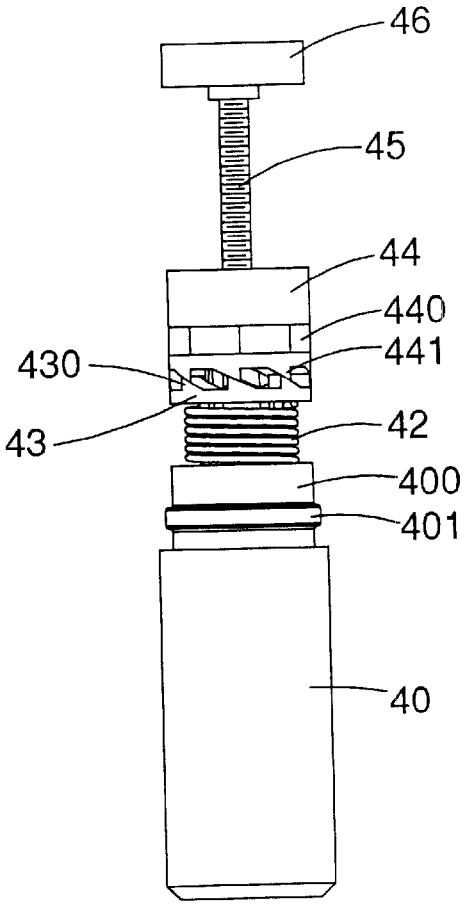
FIGS. 5 and 6 are side views showing the action of the material-extracting device of the present invention.
Figure 5:
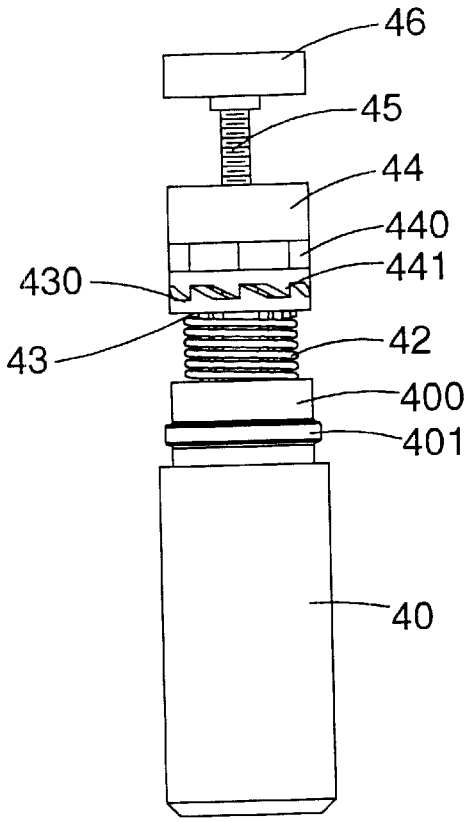

Referring to FIGS. 2 to 4, when the rotational cap 40 rotates clockwise, the driving rod 41 will drive the ratchet wheel 43 to rotate clockwise. At the same time, the piston 46 will move upward as a result of the piston rod 45 being driven by the screw hole 411 by the driving rod 41. The make-up lotion 5 on the top thereof is squeezed upward to the brush 21 by the material directing tube 220 of the material guiding needle 22 to expose to the upper portion of the mounting head 20 for application. When the ratchet wheel 43 rotates clockwise, the teeth 430 will not move for the reason that the securing seat 44 is secured to the pen body 1. The sloping face of the teeth 43 will move along the teeth 441 of the securing seat 44 so that the ratchet wheel 43 will be lowered and compress the compression spring 42, as shown in FIGS. 5 and 6, until the teeth 430 of the ratchet wheel 43 is moved to the teeth 441 of the securing seat 44. At this instance, the ratchet wheel 43 will restore to its original position by the spring force of the compression spring 42. Thus reverse direction of the ratchet wheel will not be possible and the amount of cosmetic is effectively controlled.

The advantages of the present invention is that the cosmetic or the make-up lotions is contained within the pen body, and the brush is in combination with the make-up lotion, it can be conveniently inserted to a pocket, or any pocket within the handbag. Furthermore, the amount of cosmetic from the pen body is effectively controlled. This can be achieved by rotating the driving rod 41 to drive the brush with make-up lotion 5 to move upward for application.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. An improved structure of a make-up pen comprising:

a pen body having a cavity to contain a make-up lotion;

a head portion being a mounting head and located at one end of the pen body and having a brush partially protruded out to the exterior thereof, and a material-guiding needle being located within the brush;

a cap body mounted at one end of the pen body for the capping of the head portion;

a material-extracting device including a rotational cap, a driving rod, a compression spring, a ratchet wheel, a securing seat, a piston rod and a piston, wherein the rotational cap is mounted at the other end of the pen body and has one end extended to the driving rod within the pen body, and the compression spring and the ratchet wheel are mounted onto the driving rod, and the securing seat is mounted to the pen body with the end of the driving rod, and the bottom face of the securing seat and the top face of the ratchet wheel are provided with mutually engaged teeth, and the end portion of the driving rod has a screw hole and the piston rod is mounted within the screw hole and passes through the securing seat, and the end portion of the piston rod is provided with the piston; and a plurality of make-up lotion filled at the lower section of the head portion of the pen body and the cavity located above the material-extracting device.

2. The improved structure of a make-up pen of claim 1, wherein the top end opening of the pen body is provided with a protruded edge having a plurality of protruded rings for the mounting of the cap body, and the inner hole wall of the protruded edge is provided with a plurality of engaging grooves for the engagement of the head portion, and the lower end of the inner hole wall of the pen body is provided with a polygonal securing slot for the mounting with the securing seat, and the inner hole wall is provided with ringed slot for the mounting of the material-extracting device.

3. The improved structure of a make-up pen of claim 1, wherein one end of the mounting head is provided with an engaging edge for insertion into the opening at the upper portion of the pen body, and the engaging edge is provided with a plurality of ringed ribs for engagement with the engaging grooves, and a through hole is located on the mounting head and the hole wall of the through hole is provided with a plurality of rib plate, and the bottom region of the brush has a protruded seat for urging with the bottom region of the rib plate so that the brush passes through the through hole and the upper section of the brush is exposed above the mounting head and the protruded seat is provided with a through hole, and the material-guiding needle is positioned at the bottom section of the mounting head, and a material-directing tube passed through the through hole of the protruded seat is provided to the material-guiding needle, and the end portion of the material-directing tube extends to the exterior of the mounting head until the front section of the brush.

4. The improved structure of a make-up pen of claim 1, wherein one end of the rotational cap is a protruded pivotal edge for insertion at the opening at the bottom section of the pen body and the circumferential edge of the pivotal edge is a protruded ring for engaging with the ringed groove of the pen body, and the rotational cap is provided with an upward opened, polygonal engaging hole for the insertion of the lower section of the driving rod.

5. The improved structure of a make-up pen of claim 1, wherein the circumferential edge of the driving rod is provided with a plurality of engaging flat surfaces, allowing engagement with the engaging hole of the rotational cap so as to be driven to rotate, or for the mounting of the ratchet wheel to drive the ratchet wheel.

6. The improved structure of a make-up pen of claim 1, wherein the bottom section of the compression spring urges the top portion of the rotational cap, and the top section of the compression spring urges the lower section of the ratchet wheel.

7. The improved structure of a make-up pen of claim 1, wherein the ratchet wheel is provided with a polygonal through hole for mounting with the driving rod so as to be driven by the driving rod.

8. The improved structure of a make-up pen of claim 1, wherein the circumferential edge of the securing seat is provided with securing engagement edge of polygonal shape for mounting within the securing hole of the pen body, and the securing seat is a through hole allowing the piston rod to pass through.

9. The improved structure of a make-up pen of claim 1, wherein the piston rod is threaded with screw threads for mounting to the screw hole of the driving rod, and the end section of the piston rod is provided with an engaging block to engage with the piston.

10. The improved structure of a make-up pen of claim 1, wherein the bottom section of the piston has an engaging hole for engagement with the engaging block of the end portion of the piston rod.

* * * * *